US006742604B2

(12) United States Patent
Brazil et al.

(10) Patent No.: US 6,742,604 B2
(45) Date of Patent: Jun. 1, 2004

(54) ROTARY CONTROL OF ROTARY STEERABLES USING SERVO-ACCELEROMETERS

(75) Inventors: Stewart Blake Brazil, Cambridge, MA (US); Mark Kuchenbecker, Rosenberg, TX (US); Ronggang Zhang, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 2 days.

(21) Appl. No.: 10/113,136

(22) Filed: Mar. 29, 2002

(65) Prior Publication Data

US 2003/0183423 A1 Oct. 2, 2003

(51) Int. Cl.[7] ..... E21B 47/02; E21B 47/024
(52) U.S. Cl. ..... 175/45; 175/61; 166/255.2
(58) Field of Search ..... 175/45, 27, 73, 175/79, 61; 166/255.2

(56) References Cited

U.S. PATENT DOCUMENTS

| | | | | |
|---|---|---|---|---|
| 4,510,696 A | | 4/1985 | Roesler | |
| 4,894,923 A | | 1/1990 | Cobern et al. | |
| 4,958,125 A | | 9/1990 | Jardine et al. | |
| 5,128,867 A | * | 7/1992 | Helm | 702/9 |
| 5,139,094 A | | 8/1992 | Prevedel et al. | |
| 5,265,682 A | | 11/1993 | Russell et al. | |
| 5,610,337 A | * | 3/1997 | Nelson | 73/651 |
| 5,646,611 A | | 7/1997 | Dailey et al. | |
| 5,720,355 A | | 2/1998 | Lamine et al. | |
| 5,758,539 A | * | 6/1998 | Naville et al. | 73/152.03 |
| 6,065,219 A | * | 5/2000 | Murphey et al. | 33/544 |
| 6,079,505 A | * | 6/2000 | Pignard et al. | 175/40 |
| 6,092,610 A | * | 7/2000 | Kosmala et al. | 175/61 |
| 6,158,529 A | | 12/2000 | Dorel | |
| 6,206,108 B1 | | 3/2001 | MacDonald et al. | |
| 6,230,822 B1 | | 5/2001 | Sullivan et al. | |
| 6,268,726 B1 | * | 7/2001 | Prammer et al. | 324/303 |
| 6,435,286 B1 | * | 8/2002 | Stump et al. | 175/26 |

FOREIGN PATENT DOCUMENTS

GB 2 373 862 10/2002

* cited by examiner

*Primary Examiner*—David Bagnell
*Assistant Examiner*—Daniel P Stephenson
(74) *Attorney, Agent, or Firm*—Jennie Salazar; Brigitte Jeffery Echocs

(57) ABSTRACT

A system and method for steering a rotating downhole drilling tool is provided. The downhole tool includes an inclinometer having directional accelerometers capable of measuring drilling parameters, such as angular position and centripetal acceleration, of the downhole tool. An offset accelerometer is further included for determining centripetal acceleration of the downhole tool. Collar rotation rate and the toolface may be determined from the drilling parameters. Filters, analog to digital converters and processor devices may be used to process the signals and send commands in response thereto for steering the tool.

30 Claims, 6 Drawing Sheets

ROTARY CONTROL OF ROTARY STEERABLES USING SERVO-ACCELEROMETERS

BACKGROUND OF THE INVENTION

1. Field of the Invention

The present invention relates to a control system and method utilizing servo-accelerometers to determine the rotation rate and angular position information of a rotating downhole drilling tool. However, the system may be useful in any other similar apparatus where the sensors are mounted on a rotating housing and rotation rate and/or angular position information is needed.

2. Description of the Related Art

An oil or gas well often has a subsurface section that is drilled directionally towards a desired target. To reach that target, the well follows a trajectory inclined at an angle with respect to the vertical, the inclination, and oriented towards a particular compass heading, the azimuth. Although wells having deviated sections may be drilled at any desired location, a significant number of deviated wells are drilled in the marine environment. In such case, a number of deviated wells are drilled from a single offshore production platform in a manner such that the bottoms of the boreholes are distributed over a large area of a producing horizon over which the platform is typically centrally located. Wellheads for each of the wells are located on the platform structure. Directional wells may be drilled from any type of wellbore, platform or non-platform type.

A rotary steerable drilling system steers the drill bit while the drill bit is being rotated by the collar of the tool. This enables drilling personnel to readily navigate the wellbore from one subsurface oil reservoir to another. The rotary steerable drilling tool enables steering of the wellbore both from the standpoint of inclination and from the standpoint of azimuth so that two or more subsurface zones of interest can be controllably intersected by the wellbore being drilled. Rotary steerables were developed to reduce friction for extended reach situations, but also improve downhole control. Examples of rotary steerable tools are disclosed in commonly assigned U.S. Pat. Nos. 6,092,610 and 6,158,529, the entirety of which are incorporated herein by reference.

A non-rotary steerable tool has structure that provides a bend angle such that the axis below the bend point, which corresponds to the rotation axis of the bit, has a bit angle with respect to a reference, as viewed from above the tool. The bit's angular position establishes the azimuth or compass heading at which the deviated borehole section will be drilled as the mud motor is operated. Furthermore, the bit's angular position controls the tendency for the well to build or drop in inclination. After the bit angle has been established by slowly rotating the drill string and observing the output of various orientation devices, the mud motor and drill bit are lowered, with the drill string non-rotatable to maintain the selected bit angle, and the drilling fluid pumps, "mud pumps", are energized to develop fluid flow through the drill string and mud motor, thereby imparting rotary motion to the mud motor output shaft and the drill bit that is fixed thereto. The presence of the bend angle causes the bit to drill on a curve until a desired borehole inclination has been established. To drill a borehole section along the desired inclination and azimuth, the drill string is then rotated so that its rotation is superimposed over that of the mud motor output shaft, which causes the bend section to merely orbit around the axis of the borehole so that the drill bit drills straight ahead at whatever inclination and azimuth have been established. Measurement-while-drilling "MWD" systems commonly are included in the drill string above the mud motor to orient the angular position of the bent angle and monitor the progress of the borehole being drilled so that corrective measures can be instituted if the various borehole parameters indicate variance from the projected plan.

Various rotary steerable downhole drilling tools make use of a non-rotating section that contains sensors that determine the direction to apply a force or point the drill bit. In the type of these tool having a non-rotating section that houses the sensors, some of these prevent the non-rotating section from rotating by contact with the well bore. Others stabilize the non-rotating section using control from a rotating rate sensor. Accelerometer data can be filtered to remove noise from shock and vibration, and used directly to determine the direction to apply a steering force. In the type of tool where the section containing the sensors rotates with the collar, rotation rate is measured by either a gyroscope or magnetometers. Control is applied to the steering section to counteract the rotation rate to make it geostationary.

Tri-axial magnetometers (3 magnetometers mounted orthogonal to each other, 1 axial and 2 radial) are commonly used to determine rotation rate and position of the tool. The rotation rate, or angular velocity, relates to the speed of rotation of the tool during drilling. The position of the tool, often referred to as the "toolface", relates to the steering direction of the tool with respect to vertical (the direction opposite the earth's gravity). By manipulating the rotation rate and/or toolface, the tool may be steered in the desired direction. However, when drilling in the same direction as the earth's magnetic field, the radial component of tri-axial magnetometers becomes too small to be used to determine rotation rate and/or tool face for steering. Gyroscopes work in any magnetic field and can measure rotation rate, but currently available gyroscopes are too inaccurate to generate position information, and do not work well at high temperatures, or during extreme shock and vibration, common to downhole environments.

There remains a need for improved steering control, particularly when drilling into the earth's magnetic field. The present invention utilizes rotational and offset accelerometers to obtain rotation rate and toolface to meet one or more of these needs.

SUMMARY OF THE INVENTION

Briefly, a system and method are provided for determining rotation rate and angular position information of a rotating downhole drilling tool. First, second and third accelerometers are mounted to a collar that is controlled to rotate in the downhole drilling tool. Each of the first, second and third accelerometers are positioned so that their respective measurement points are centered on an axis of rotation and aligned with a corresponding x, y and z Cartesian coordinate axis of the collar, wherein the x-axis is the axis of rotation of the collar. A fourth accelerometer is mounted to the collar and positioned offset from the axis of rotation of the collar by an offset distance and aligned with the second accelerometer. The fourth accelerometer generates a signal representing centripetal acceleration of the collar as a function of the offset distance. The signals output by the accelerometers are processed to generate therefrom one or both of collar rotation rate and toolface position of a bit shaft coupled to the collar through a geostationary offset mandrel. In an alternate embodiment, the directional accelerometers may be offset with respect to the x, y and z axes.

An embodiment of the invention relates to a system for determining rotation rate and position information of a rotating downhole drilling tool. The system includes an inclinometer, an offset accelerometer, an analog to digital converter and a processor. The inclinometer is mounted to a collar in the drilling tool. The inclinometer comprising multiple accelerometers positioned so that their respective measurement points are centered on the axis of rotation and aligned with a corresponding x, y and z Cartesian coordinate axis of the collar. The inclinometer generates output signals representing position of the collar with respect to gravity. The offset accelerometer mounted to said collar and positioned offset from the axis of rotation of the collar by an offset distance and aligned with one of the accelerometers in the inclinometer. The offset accelerometer generates a signal representing centripetal acceleration of the collar as a function of the offset distance. The analog to digital converter is coupled to the inclinometer and to the offset accelerometer to convert the output signals thereof into digital signals. The processor device is coupled to the analog to digital converter to process the digital signals and generate therefrom one or both of collar rotation rate and position of a toolface of a bit shaft coupled to the collar through a geostationary offset mandrel.

Another embodiment relates to a steerable rotating downhole drilling tool. The tool includes an inclinometer mounted to a collar in the drilling tool and an offset accelerometer. The inclinometer is provided with directional accelerometer capable of taking collar measurements for determining desired drilling parameters. The offset accelerometer is mounted to said collar offset a distance from the inclinometer. The offset accelerometer capable of measuring centripetal acceleration of the collar for adjusting one or more of the collar measurements whereby more accurate desired drilling parameters may be determined.

Another embodiment relates to a method for generating rotation rate and/or toolface position information of a rotating downhole drilling tool. The method includes the steps of detecting an inclination of a rotating collar in a downhole drilling tool that drives a bit shaft to form a borehole in an earth formation using accelerometers mounted to said collar, detecting centripetal acceleration of the collar using an offset accelerometer mounted to said collar offset by a distance from the axis of rotation of the collar, and generating one or both of collar rotation rate and toolface position of a bit shaft coupled to the collar through a geostationary offset mandrel from the detected inclination of the collar and the centripetal acceleration of the collar.

Another embodiment relates to a method for steering a rotating downhole drilling tool having a drill collar. The steps include detecting acceleration of the collar using at least one directional accelerometer mounted to said collar, detecting acceleration of the collar using an offset accelerometer mounted to said collar, the offset accelerometer positioned parallel to at least one directional accelerometer a distance therefrom, measuring the resolver angle of the collar, generating collar rotation rate of a bit shaft and a toolface position, and adjusting the counter rotation speed of the offset mandrel whereby the tool is steered in the desired direction.

Other aspects and advantages of the invention will be apparent from the following description and the appended claims.

DETAILED DESCRIPTION OF THE INVENTION

Figure 1A:
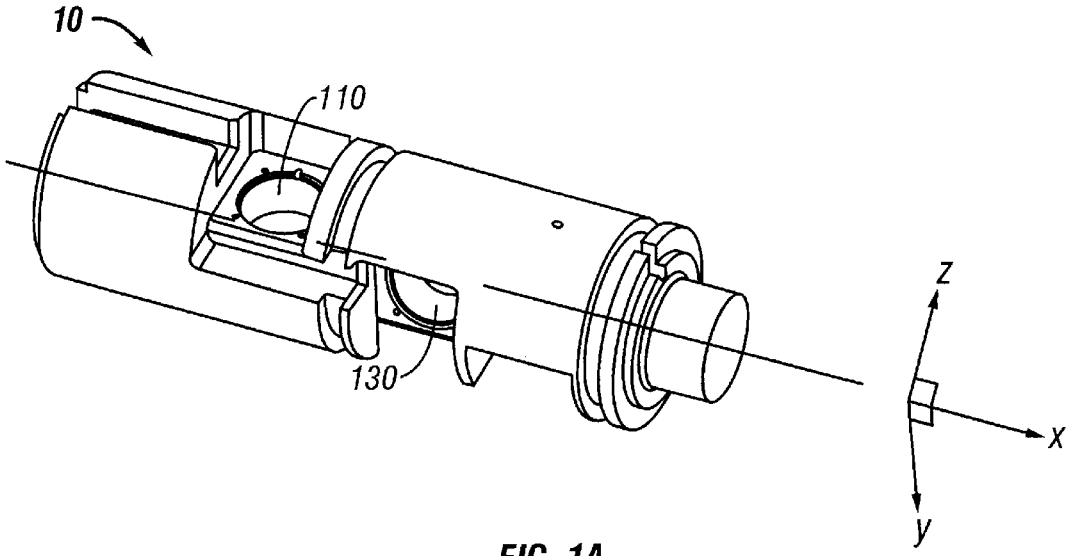
FIG. 1A is a perspective view of an accelerometer assembly mounted to a collar housing used in a rotary steerable downhole drilling tool, and including directional accelerometers mounted in a particular configuration with respect to coordinate axes axially aligned with the collar housing.
Figure 1B:
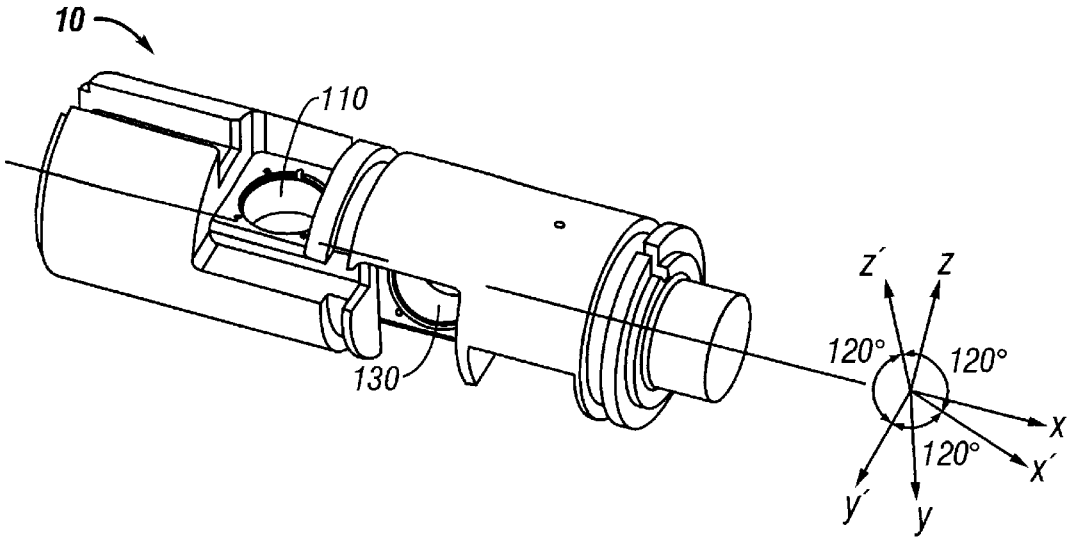
FIG. 1B is a perspective view of the accelerometer assembly and downhole drilling tool of FIG. 1A, including accelerometers mounted in a particular configuration with respect to coordinate axes offset from the axis of the collar housing.
Figure 2:
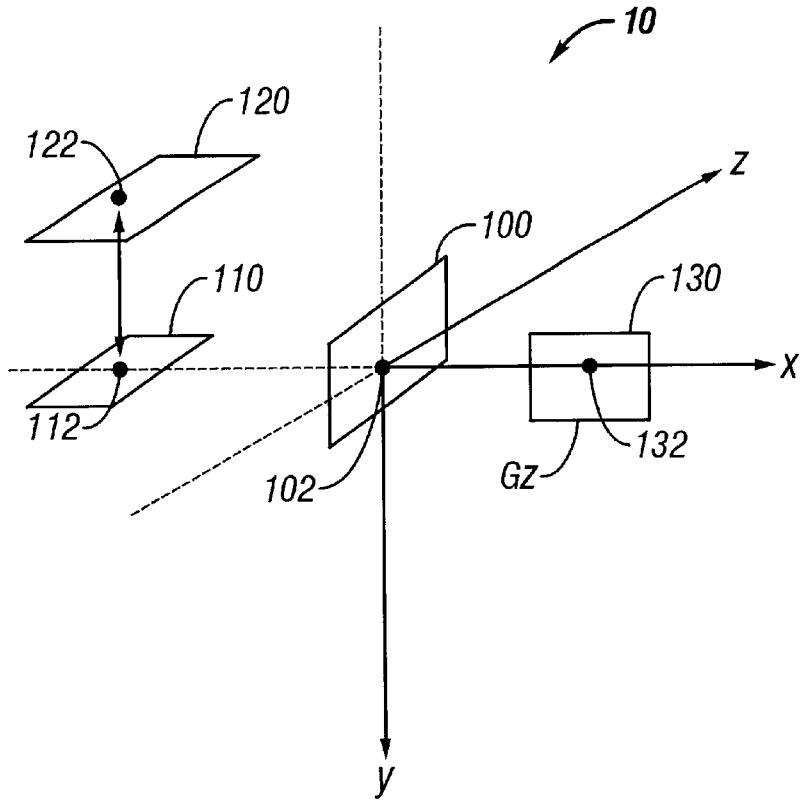
FIG. 2 is a graphical diagram showing the positions, with respect to the coordinate axes, of all four accelerometers mounted in the collar housing shown in FIG. 1.

A control system and method to control the steering element of a rotary steerable tool system are provided using servo accelerometers in place of gyroscope sensors and magnetometer sensors. With reference to FIGS. 1A, 1B and 2, the accelerometer sensor package is generally at reference numeral 10. The sensor package 10 contains four accelerometers, 100, 110, 120 and 130. Accelerometers 100, 110 and 130 are directional accelerometers forming a traditional 3-axis measure-while-drilling (MWD) inclinometer that generates output signals representing position of the collar with respect to earth's gravity. A fourth accelerometer 120, or offset accelerometer, is provided at a position offset from the directional accelerometers.

As shown in FIG. 1A, the measurement point of each of the directional accelerometers 100, 110 and 130 in the inclinometer is centered on the tool's axis of rotation and aligned with one of the collar's Cartesian coordinate axes (x, y, z). In the diagrams, the axis of rotation of the collar is the x-axis. Furthermore, the measurement point 102 of directional accelerometer 100 is aligned with the x-axis, i.e., where x=0, and is therefore referred to as Gx. Directional accelerometer 100 measures the x-axis component of gravity on the collar. Measurement point 112 of directional accelerometer 110 is aligned with the y-axis, where y=0, and is referred to as Gy. Directional accelerometer 110 measures the y-axis component of gravity on the collar. Measurement point 132 of directional accelerometer 130 is aligned with the z-axis and is referred to as Gz. Directional accelerometer 130 measures the z-axis component of gravity on the collar. The measurement point 122 of the offset accelerometer 120, called GyO, is offset from the tool's axis of rotation by an offset distance r, and is aligned with the y-axis directional accelerometer 110. FIG. 2 graphically depicts the accelerometers with respect to the Cartesian coordinate axes. Unlike the traditional 3 axis directional accelerometer, the offset accelerometer 120 is sensitive to the centripetal acceleration of the collar, with respect to the x-axis. The centripetal acceleration that the offset accelerometer 120 experiences is a function the collar's rotation rate and the offset distance. The offset distance, r, is for example, ½ inch (0.013 m). As a result, the offset accelerometer 120 can be used to estimate the rotation rate of the collar. By aligning the directional accelerometer 110 (Gy) and offset accelerometer 120 (GyO) in the same axis, environmental perturbations from shock and vibration, which can be much greater than the centripetal acceleration, will be common to both Gy and GyO sensors and can be cancelled out during signal processing.

As will be understood by one of skill in the art, the coordinate axes of the accelerometers may be aligned with the axis of rotation of the collar as depicted in FIG. 1A, or offset at some angle as depicted in FIG. 1B. FIG. 1B depicts the directional accelerometers 100, 110 and 130 aligned with a coordinate axis (x', y,' z') that is offset with respect to the axis of the tool. In this embodiment, directional accelerometer 100 is aligned with the x'-axis, directional accelerometer 110 is aligned with the y'-axis and directional accelerometer 130 is aligned with the z'-axis. The fourth offset accelerometer 120 remains offset from the tool's axis of rotation by an offset distance r, and aligned with the y'-axis directional accelerometer 110. Preferably, the offset accelerometer 120 is parallel to the directional accelerometer 110.

Additionally, unlike the orthogonal axes of FIG. 1A, the offset axes of FIG. 1B have 120 degree angles between the axes. Moreover, the angles between the axes may be orthogonal as depicted in FIG. 1A or at a non-orthogonal angle as depicted in FIG. 1B. The non-orthogonal angle may be greater or less than 90 degrees. The measurements taken by the directional and offset accelerometers along the offset axis and at various angles may be mathematically interpolated back to the standard Cartesian axis (x, y, z) as depicted in FIG. 2 as will be understood by one of skill in the art.

Accelerometers useful in the accelerometer assembly 10 may be linear accelerometers, preferably analog torque sensing, balance beam or digital accelerometer commercially available from various suppliers such as Honeywell™, Sextant™ and JAE™.

Figure 3:
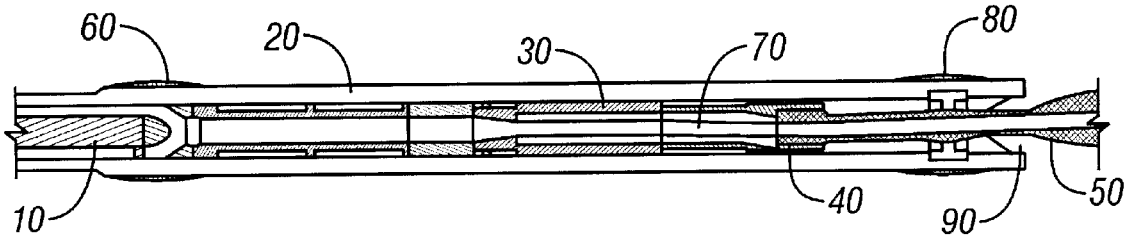
FIG. 3 is a sectional view of a portion of a rotary steerable downhole drilling tool in which the electronics assembly shown in FIG. 1 is used.

Referring to FIG. 3, one application of the control system is shown. The accelerometer assembly 10 is mounted in a collar 20, and therefore rotates with the collar 20 of the tool. Again, the x-axis corresponds to the axis of rotation of the collar in the tool. The accelerometers 110 (Gy) and 130 (Gz) (called radial accelerometers) of the inclinometer package are used for toolface position control of the steering element. A servomotor (and gearbox) 30 is mounted to the same collar 20 as the accelerometer package 10. The output shaft 70 is coupled (through the gearbox) to a geostationary offset mandrel 40. A bit shaft 50 is connected to the offset mandrel 40 such that the angular position of the mandrel 40 determines the direction that the bit shaft is pointed. Other elements of the tool shown in FIG. 3 include an upper stabilizer 60, a near-bit stabilizer and a bellows 90. Other details of a rotary steerable tool are disclosed in the aforementioned commonly assigned U.S. patents.

Figure 4:
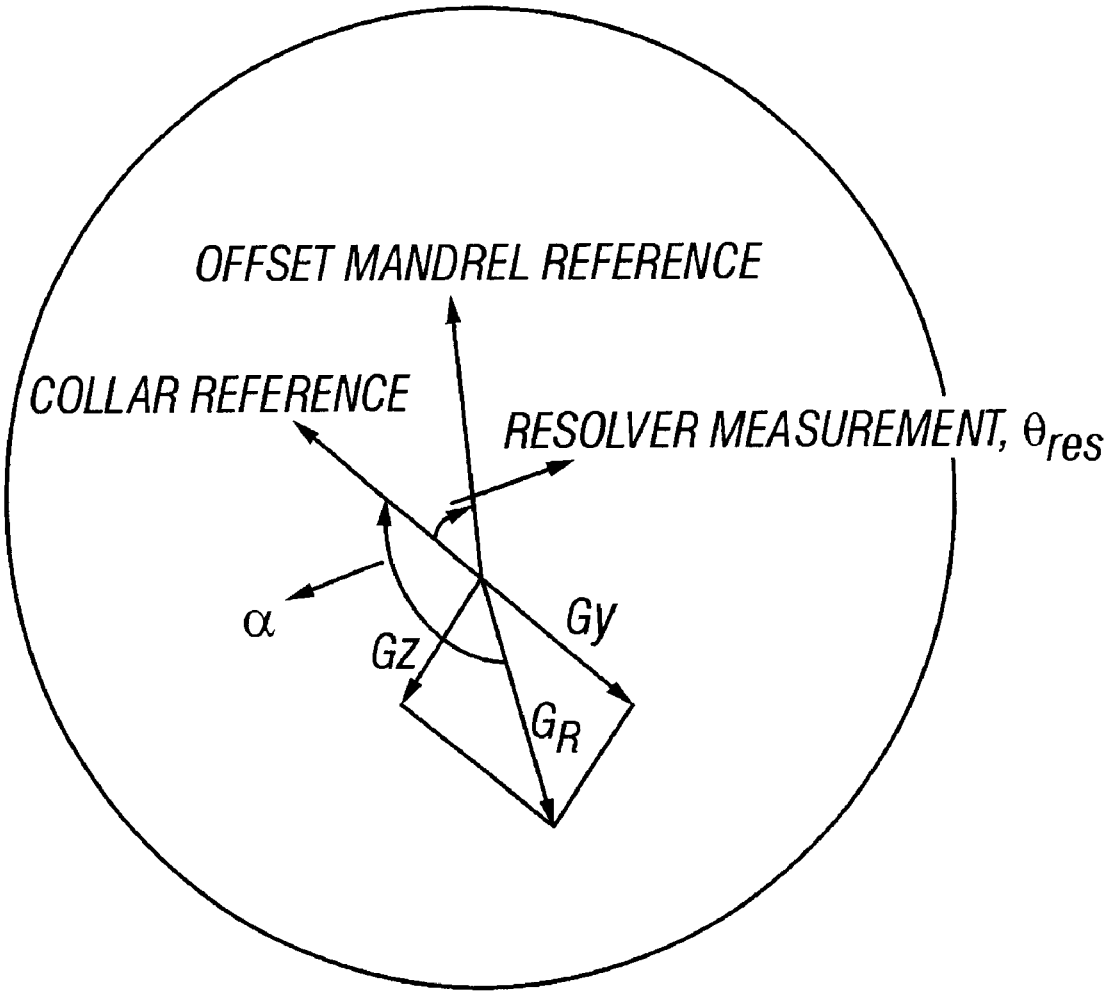
FIG. 4 is a diagram showing determination of an angular relationship of tool elements used for purposes of generating toolface position information.

FIG. 4 is a graphical depiction of the tool showing the angular relationships between the collar and the offset mandrel as would be viewed at a cross section of the tool shown in FIG. 3. An angle, hereinafter referred to as the resolver angle, $\Theta_{res}$ is a measure of the angular relationship between the collar and the motor output shaft, which is the same as the angle between the sensors and the bit shaft direction or the angle between the collar reference and offset mandrel reference.

In normal operation, the collar is rotated by the drill string in one direction, such as clockwise. By rotating the motor output shaft counter clockwise at the same rotation rate as the collar, the bit-shaft direction can be held in a relatively stable geostationary angle or position. When matching the rates in this way, the bit-shaft changes its angular position slowly. This process uses that fact to its advantage, and takes the rotating, angular position vector from the radial accelerometers, translates that using the resolver angle $\Theta_{res}$, into the mandrel (bit-shaft) reference angle. This output angle is centered about a geostationary position and can be filtered relatively easily with a low pass filter. Without the translation to a relatively geostationary reference, the rotating angular position from the accelerometers would have had to be filtered with a fairly high Q, bandpass filter centered about the rotation rate, which is constantly changing.

As shown in FIG. 4, the angle $\alpha$ is the angle between the collar reference and the radial $G_R$ vector. The radial $G_R$ vector is the earth's gravity vector and may be determined from the component vectors Gy and Gz, which correspond to the output of the directional accelerometers 110 and 130. The sum of the angles $\alpha+\Theta_{res}$ is the gravity toolface of the bit shaft.

The device used to determine the resolver angle may take on a variety of forms, such as a port-inertial angular position sensor. One example of such a device, also called an angular position sensor, is disclosed in U.S. Pat. No. 5,758,539, the entirety of which is incorporated herein by reference. For example, it may be a standard inductive device having a stator that is mechanically anchored to the tool collar and a rotor that is mounted on the output shall of the gearbox, which is tied to the bit shaft orientation as will be understood by one of skill in the art. This device, a resolver, provides a measurement of the angle between the collar and the offset mandrel and hence, bit-shaft direction. Alternatively, the resolver may be a Hall effect sensor or an optical sensor, or other suitable devices that can be used to measure the angle between the collar and the offset mandrel, as is well known in the art.

Figure 5:
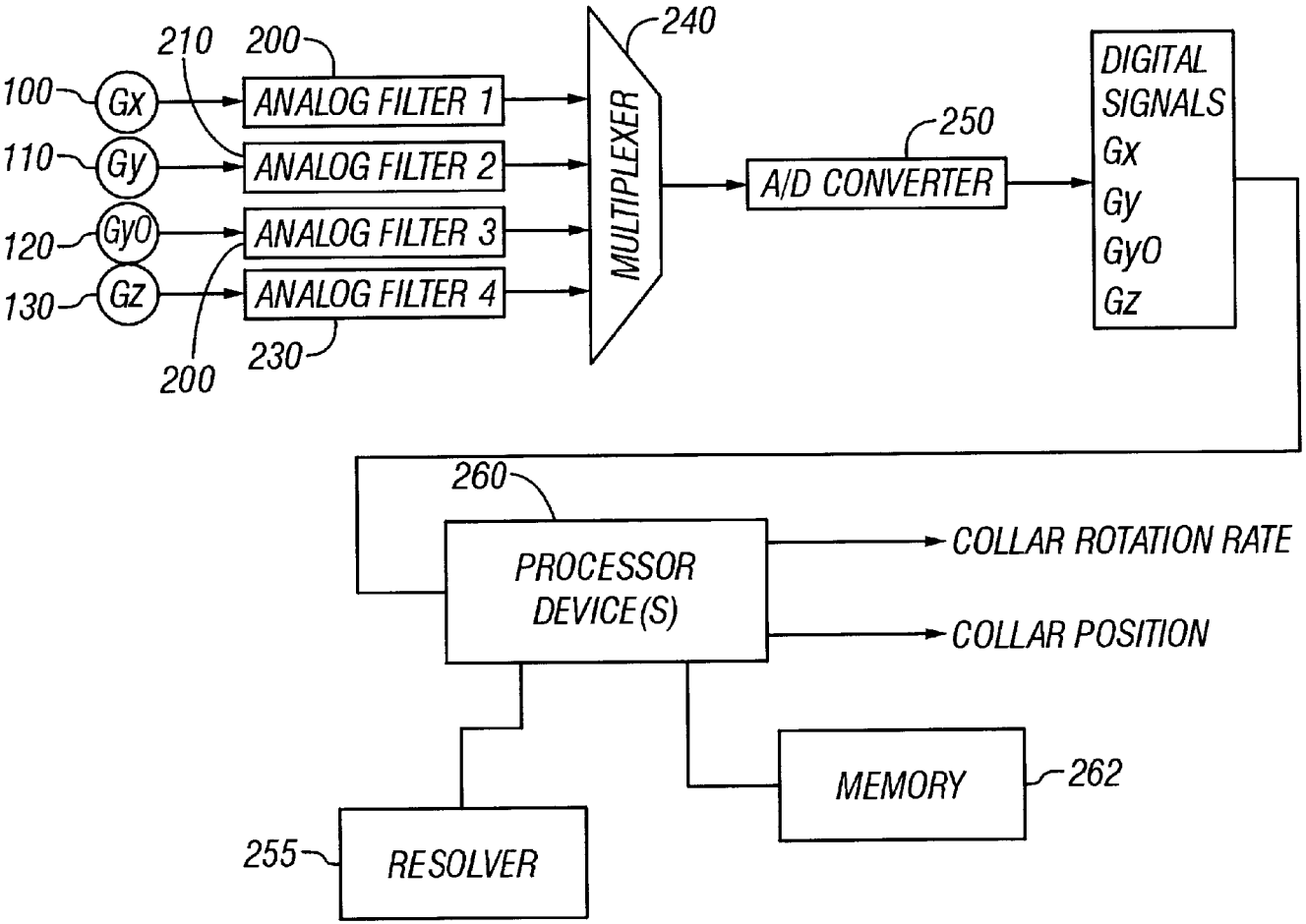
FIG. 5 is a block diagram showing the signal processing circuitry used for processing signals from the accelerometers shown in FIGS. 1 and 2.
Figure 6:
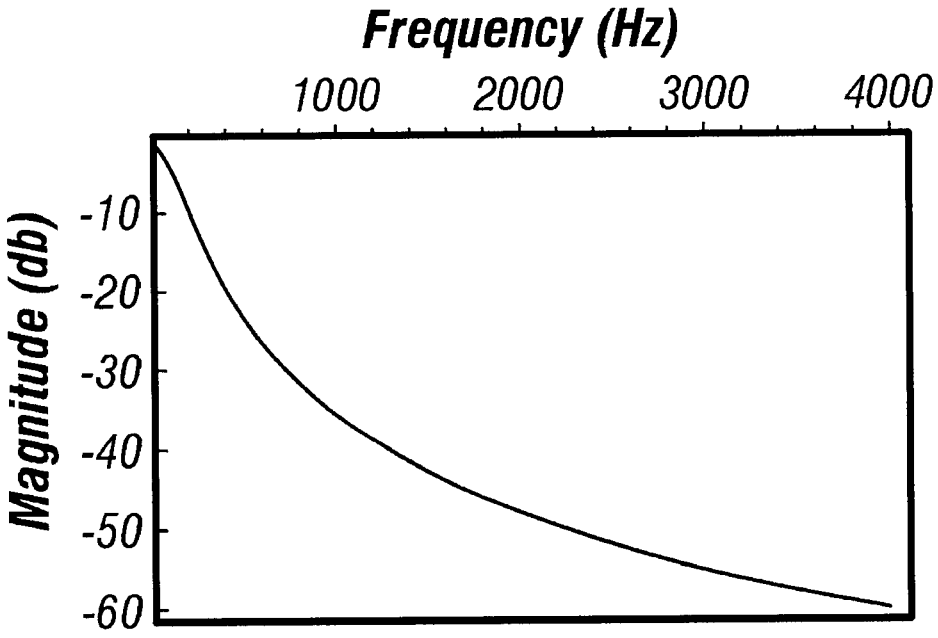
FIGS. 6 and 7 are graphical diagrams showing filter amplitude and phase responses for analog filters used to filter the raw accelerometer signals.
Figure 7:
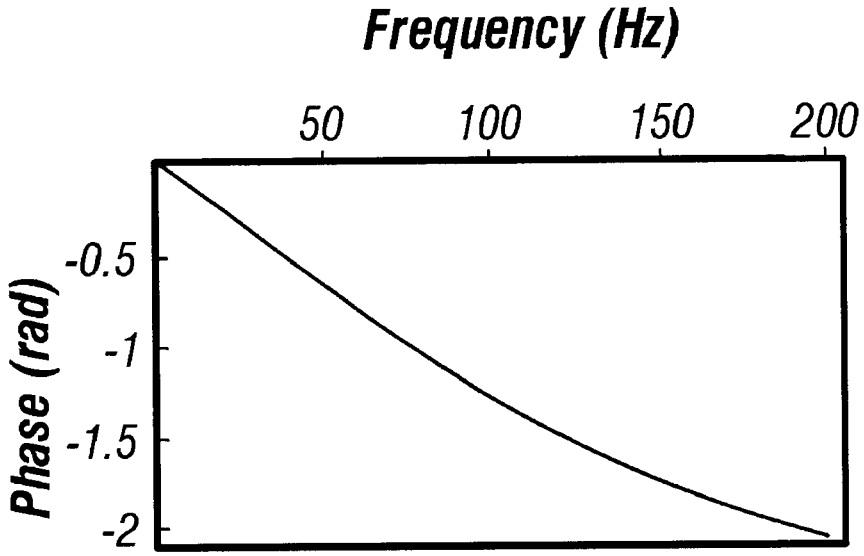

With reference to FIG. 5, the signal processing aspect of the control system will be described. Prior to digitizing, the output signals from the accelerometers 110, 120 and 130 are coupled to low pass filters 210, 220 and 230, respectively. The filters 210–230 are, for example, analog low-pass filters with a–3 dB frequency of 100 Hz. The transfer function is based on a linear phase filter. The phase and magnitude response curves for the radial low-pass filters are shown in FIGS. 6 and 7, respectively.

The filters 210–230 may also convert the accelerometer output from a current to a voltage. The filtered signals, now voltage signals, are fed through a multiplexer 240 to an analog-to-digital (AID) converter 250. The A/D converter 250 converts the filtered signals to digital signals, according to characteristics such as those shown in the table below. Thus, the output of the A/D converter 250 comprises digital signals representing low-pass filtered versions of the output signals of the accelerometers 100–130.The preferred A/D converter useful with the downhole tool may be any A/D converter capable of providing a reasonably accurate digital representation of the equivalent analog input value. Preferably, the A/D converter has a minimum resolution of 12 bits and conversion rate consistent with the collar's maximum rotation speed. Such A/D converters are available from various suppliers such as Analog Devices™, Burr Brown™, Crystal Semiconductor™, and others in the electronic industry.

Figure 8:
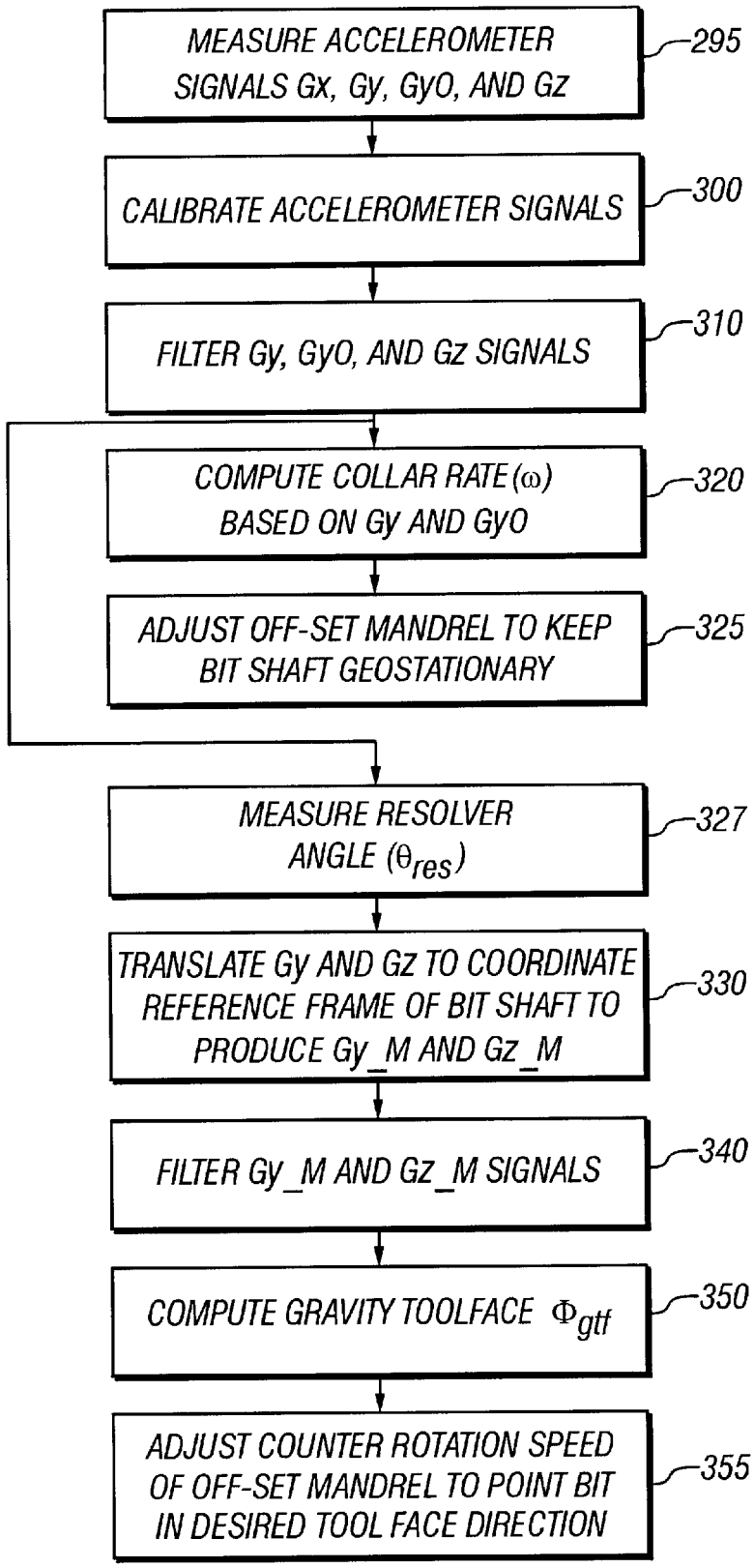
FIG. 8 is a flow chart showing processing steps performed to generate the rotation rate and toolface information.

Once the filtered accelerometer output signals are digitized, they may be processed by a digital processor or data processor of any suitable type. This processor device is identified by reference numeral 260 in FIG. 5. For example, the processor device 260 may be a digital signal processor (DSP), such as an Analog Devices 2181 DSP chip, a microprocessor, a computer (such as a personal computer or higher powered computer), etc., programmed accordingly to perform the functions described herein (and shown in FIG. 8). Depending on the type of processor device employed, there may be an accompanying processor readable memory 262 (read only, writable or rewritable) that stores instructions executed by the processor to perform the functions described herein. Memory 262 may be internal or external to the processor device itself. It is understood that depending on the type of processor, there may be additional working memory, internal or external to the processor device 260 itself. Alternatively, processor device 260 is one or more application specific integrated circuits (ASIC) designed to perform the functions described herein. The individual computation processes described hereinafter may be performed by separate digital processors or digital integrated circuits of any suitable type. The particular structural arrangement of the processor device 260 can vary depending on the application and particular environmental situation. Moreover, the functions of the filters 210–230 may be performed by digital processes, wherein the output of the accelerometers 100–130 would be digitized sooner in the overall process. Conversely, it is possible that certain situations may justify performing the processes shown and described herein as digital processes, using analog signal processing techniques.

The particular implementation (analog or digital) aside, there are several processing steps that are performed to generate collar rate and position information from the accelerometer output signals. These processing steps are shown in the flow chart of FIG. 8. In step 295, the directional accelerometers take measurements Gx, Gy, and Gz, and the offset accelerometer takes measurement GyO. In step 300, a calibration correction process is applied to the filtered accelerometer output signals. The calibration correction process 300 adjusts the data for errors from temperature and misalignment to within 1 mG relative error. The correction coefficients for the calibration process are supplied by the accelerometer manufacturer and is a standard process known to those with ordinary skill in the art. However, in this instance, the calibration process is performed continuously in real time. Temperature sensors disposed in the appropriate locations of the tool provide temperature data to the processing device 260 to allow for continuous real-time calibration. The output of a resolver 255 or angular position sensor, described above, is coupled to the processor 260 to supply the resolver angle $\Theta_{res}$ for processing.

After calibration correction, the digital signals representing the output of accelerometers 110 and 120 (Gy and GyO) are filtered in step 310. The filtering step 310 may involve finite impulse response (FIR) low pass filtering to further remove low level, broadband electrical noise, easily removed with a simple low-pass filtering process. The velocity error is largest at low rates of rotation, and during heavy vibration, which can also induce vibration rectification. This creates a minimum rotation rate for proper control.

After filtering, the magnitude of the collar rotation rate w is computed in step 320 using equation (1) below and substituting a nominal offset distance of ½ inch (0.013 m) for r. An offset distance of ½ inch (0.013 m) has been determined to be suitable for a tool diameter of about 6 ¾", but other distances may be suitable, depending on the size of the tool, and the dynamic range of the accelerometers.

$$|w| = \sqrt{\frac{|Gyo - Gy|}{r}} \tag{1}$$

Once the collar rotation rate w is determined, step 325 is performed to make an incremental adjustment to counter rotate the speed of the offset mandrel to keep the bit shaft geo-stationary. In this step, the rotation rate of the counter rotating offset mandrel may be adjusted to more closely match the rotation rate of the collar. This is done by a control algorithm which increases the counter rotating velocity of the offset mandrel if it is too low, or decreases it if it is too high as will be understood by one of skill in the art. By manipulating the rotation rate of the offset mandrel, the rotation aspect of the drilling process may be controlled.

With reference to FIG. 4, in conjunction with FIGS. 3 and 5, the control system estimates the bit-shaft gravity toolface using the output of accelerometers 110 (Gy) and 130 (Gz) and the resolver angle $\Theta_{res}$. The measurement of Gy and Gz has already been performed in Step 295. The measurement of the resolver angle may then be performed in Step 327. As discussed previously, the resolver angle may be determined by measuring the angle between the collar 20 and the offset mandrel 40. The accelerometers 100–130 are mounted to, and rotate with, the collar 20 of the tool.

In step 330, a coordinate system translation is applied to translate Gy and Gz to the coordinate reference frame of the bit shaft. First, the sine and cosine of the resolver angle measurement, $\Theta_{res}$, are calculated and those values are stored in the matrix of equation (2) below. Then, the sine/cosine matrix is multiplied with signals from accelerometers 110 and 130, the radial collar sensor signals, $G_{y_c}$ and $G_{z_c}$, to produce translated accelerometer signals, also called virtual mandrel signals, $G_{y_m}$ and $G_{z_m}$. The virtual mandrel signals $G_{y_m}$ and $G_{z_m}$, are in the same coordinate frame of reference as the bit shaft.

$$\begin{bmatrix} G_{y_m} \\ G_{z_m} \end{bmatrix} = \begin{bmatrix} \cos(\Theta_{res}) & \sin(\Theta_{res}) \\ -\sin(\Theta_{res}) & \cos(\Theta_{res}) \end{bmatrix} \cdot \begin{bmatrix} G_{y_c} \\ G_{z_c} \end{bmatrix} \tag{2}$$

In step 340, the translated accelerometer signals $G_{y_m}$ and $G_{z_m}$ are digitally filtered. This filtering process may be a low pass FIR filtering process that isolates gravity from other sources of acceleration, such as shock and vibration. In step 350, the collar position, called the gravity toolface, $\Phi_{gtf}$, is calculated directly by the using the standard four-quadrant arctangent as described by equation 3, where $g_z$ and $g_y$ are the filtered output of step 340.

$$\Phi_{gtf} = \arctan(-g_z, g_y) \tag{3}$$

The computed value of Φgt, the gravity toolface, determines the direction in which the tool is drilling. As with the rotation rate, the toolface may be adjusted by counter rotating the offset mandrel (faster or slower than the nominal rotation rate of the collar). In step 355, incremental adjustments are made to counter rotate the offset mandrel to keep the bit shaft pointing in the desired toolface direction. By manipulating the offset mandrel based on the rotation rate as set forth in step 325 and/or the toolface as set forth in step 355, the tool may be steered to drill in the desired direction.

Variations and enhancements to the system described herein are envisioned. For example, a change in velocity on the collar can be clamped when the angular acceleration calculation is determined to exceed the physical acceleration capability of the collar. The analog and digital filter parameters, such as filter type, cutoff frequencies, slope, passband ripple, and stopband ripple, may be varied according to particular processing environments and data types. Additional filtering may be applied to the raw accelerometer or calculated internal values. Noise editing, such as clipping, interpolating and/or extrapolating signals, that exceed the accurately measurable amplitude, may be useful. The process of integrating the collar velocity to enhance position accuracy is another possible enhancement.

While the invention has been particularly shown with reference to the above embodiments, it will be understood by those skilled in the art that various other changes in the form and details may be made therein without departing from the spirit and the scope of the invention.

What is claimed is:

1. A system for determining rotation rate and position information of a rotating downhole drilling tool, comprising:

an inclinometer mounted to a collar in the drilling tool, the inclinometer comprising multiple accelerometers positioned so that their respective measurement points are centered on the axis of rotation and aligned with a corresponding x, y and z Cartesian coordinate axis of the collar, the inclinometer generating output signals representing position of the collar with respect to gravity;

an offset accelerometer mounted to said collar and positioned offset from the axis of rotation of the collar by an offset distance and aligned with one of the accelerometers in the inclinometer, the offset accelerometer generating a signal representing centripetal acceleration of the collar as a function of the offset distance;

an analog to digital converter coupled to the inclinometer and to the offset accelerometer to convert the output signals thereof into digital signals; and a processor device coupled to the analog to digital converter to process the digital signals and generate therefrom one or both of collar rotation rate and position of a toolface of a bit shaft coupled to the collar through a geostationary offset mandrel.

2. The system of claim 1, wherein the processor device computes a magnitude of the collar rotation rate based on the digital signals representing the output signals of the inclinometer and of the offset accelerometer, and the offset distance.

3. The system of claim 1, wherein the processor device computes the collar position by translating the digital signal representing the output of the inclinometer to a rotating coordinate system based on an angle measurement between the collar and a bit-shaft coupled to the collar through an offset mandrel.

4. The system of claim 1, wherein the inclinometer comprises first, second and third accelerometers, the first accelerometer being positioned to measure the x-axis component of gravity on the collar, the second accelerometer being positioned to measure the y-axis component of gravity on the collar, and the third accelerometer being positioned to measure the z-axis component of gravity on the collar, each of the first, second and third accelerometers generating an output signal that is digitized by the analog to digital converter.

5. The system of claim 4, wherein the processor device computes the magnitude of the collar rotation rate w based on the equation $$|w| = \sqrt{\frac{|Gyo - Gy|}{r}},$$

where Gy is a value of the digital signal representing output of the second accelerometer and Gyo is a value of the digital signal representing output of the offset accelerometer, and r is the offset distance.

6. The system of claim 5, wherein the processor device low pass filters the digital signals representing output of the second accelerometer and the offset accelerometer prior to computing the collar rotation rate.

7. The system of claim 6, wherein the processor device low pass filters the digital signals representing output of the second accelerometer and the offset accelerometer using a finite impulse response (FIR) filter process.

8. The system of claim 4, wherein the processor device translates values of the digital signals representing output of the second and third accelerometers to a rotating coordinate system according to the equation $$\begin{bmatrix} G_{y_m} \\ G_{z_m} \end{bmatrix} = \begin{bmatrix} \cos(\Theta_{res}) & \sin(\Theta_{res}) \\ -\sin(\Theta_{res}) & \cos(\Theta_{res}) \end{bmatrix} \cdot \begin{bmatrix} G_{y_c} \\ G_{z_c} \end{bmatrix},$$

where $\Theta_{res}$ is the angle measurement between the collar and a bit-shaft coupled to the collar through an offset mandrel, and $G_{y_c}$ and $G_{z_c}$ are values of the digital signals representing the output of the second and third accelerometers, and $G_{y_m}$ and $G_{z_m}$ are translated values.

9. The system of claim 8, wherein the processor device computes the toolface position (Φgtf) according based on an arctan operation on Gz_m and Gy_m.

10. The system of claim 9, wherein the processor device low pass filters Gy_m and Gz_m prior to computing (Φgtf,), such that $\Phi_{gtf}$=arctan($-g_z$,$g_y$), where gz and gy are filtered versions of Gy_m and Gz_m respectively.

11. The system of claim 10, wherein the process device low pass filters Gy_m and Gz_m using a FIR filter process.

12. The system of claim 1, and further comprising a plurality of low pass filters each of which receives the signals output by the inclinometer and the offset accelerometer to generate filtered signals.

13. The system of claim 12, wherein each of the plurality of low pass filters are two-pole analog low pass filter having a transfer function based on a linear phase Bessel filter.

14. The system of claim 1, wherein the processor device adjusts values of the digital signals output by the analog to digital converter for errors caused by temperature and/or misalignment.

15. The system of claim 1, wherein the processor device is a device selected from the group consisting of: a digital signal processor, a microprocessor, and one or more application specific integrated circuits.

16. A method for steering a rotating downhole drilling tool having a drill collar, comprising steps of:

detecting acceleration of the collar using at least one directional accelerometer mounted to said collar;

detecting acceleration of the collar using an offset accelerometer mounted to said collar the offset accelerometer positioned parallel to at least one directional accelerometer a distance therefrom;

measuring the resolver angle of the collar;

generating collar rotation rate of a bit shaft and a toolface position; and adjusting the counter rotation speed of the offset mandrel whereby the tool is steered in the desired direction;

wherein the step of generating toolface comprises translating directional accelerometer output to a rotating coordinate system according to the equation $$\begin{bmatrix} G_{y_m} \\ G_{z_m} \end{bmatrix} = \begin{bmatrix} \cos(\Theta_{res}) & \sin(\Theta_{res}) \\ -\sin(\Theta_{res}) & \cos(\Theta_{res}) \end{bmatrix} \cdot \begin{bmatrix} G_{y_c} \\ G_{z_c} \end{bmatrix},$$

where $\Theta_{res}$ is the resolver angle, and $G_{y_c}$ and $G_{z_c}$, are values of directional accelerometers mounted in alignment with respect to the y axis and z axis, respectively, of the collar and $G_{y_m}$ and $G_{z_m}$ are the translated values.

17. The method of claim 16, wherein the step of generating the toolface position information comprises computing (Φgtf,) based on an arctan operation on Gz_m and Gy_m.

18. The method claim 17, further comprising the step of low pass filtering Gy_m and Gz_m prior to computing (Φgtf,) such that $\Phi_{gtf}$=arctan($-g_z$,$g_y$), where gz and gy are filtered versions of Gy_m and Gz_m respectively.

19. The method of claim 16, wherein the step of generating collar rotation rate comprises computing w based on the equation $$|w| = \sqrt{\frac{|Gyo - Gy|}{r}},$$

where Gy is a value of the output of the directional accelerometer aligned with respect to the y-axis of the collar and GyO is a value of the output of the offset accelerometer, and r is the offset distance.

20. A method for generating rotation rate and/or toolface position information of a rotating downhole drilling tool, comprising steps of:

detecting an inclination of a rotating collar in a downhole drilling tool that drives a bit shaft to form a borehole in an earth formation using accelerometers mounted to said collar; and detecting centripetal acceleration of the collar using an offset accelerometer mounted to said collar offset by a distance from the axis of rotation of the collar; and generating one or both of collar rotation rate and toolface position of a bit shaft coupled to the collar through geostationary offset mandrel from the detected inclination of the collar and the centripetal acceleration of the collar;

wherein the step of detecting the inclination of the collar comprises detecting output from each of three accelerometers that are mounted to said collar to measure gravity components of the collar with respect to each of a respective one of the x, y and z Cartesian coordinate axes of the collar, wherein the axis of rotation of the collar is the x-axis; and wherein the step of generating toolface position information comprises translating accelerometer output to a rotating coordinate system according to the equation $$\begin{bmatrix} G_{y_m} \\ G_{z_m} \end{bmatrix} = \begin{bmatrix} \cos(\Theta_{res}) & \sin(\Theta_{res}) \\ -\sin(\Theta_{res}) & \cos(\Theta_{res}) \end{bmatrix} \cdot \begin{bmatrix} G_{y_c} \\ G_{z_c} \end{bmatrix},$$

where $\Theta_{res}$ is an angle measurement between the collar and a bit-shaft coupled to the collar through an geostationary offset mandrel, and Gy_c and Gz_c, are values of accelerometers mounted in alignment with the y axis and z axis, respectively, of the collar and Gy_m and Gz_m are the translated values.

21. The method of claim 20, wherein the step of generating the toolface position information comprises computing ($\Phi_{gtf}$) based on an arctan operation on Gz_m and Gy_m.

22. The method claim, and further comprising the step of low pass filtering Gy_m and Gz_m prior to computing ($\Phi_{gtf}$), such that $\Phi_{gtf}$=arctan($-g_z$,$g_y$), where $g_z$ and $g_y$ are filtered versions of Gy_m and Gz_m respectively.

23. The method of claim 22, wherein the step of generating the rotation rate of the collar comprises computing a magnitude of the collar rotation rate based on output of accelerometers mounted in alignment with the coordinate axes of the collar, output of the offset accelerometer, and the offset distance.

24. The method of claim 23, wherein the step of generating the magnitude of the rotation rate comprises computing w based on the equation $$|w| = \sqrt{\frac{|Gyo - Gy|}{r}},$$

where Gy is a value of the output of the accelerometer aligned with the y-axis of the collar and Gyo is a value of the output of the offset accelerometer, and r is the offset distance.

25. The method of claim 24, further comprising low pass filtering signals output by the accelerometers mounted on the collar.

26. The method of claim 24, wherein the steps of detecting the inclination and the centripetal acceleration of the collar comprises detecting analog output signals of the accelerometers mounted to said collar.

27. The method of claim 26, further comprising the step of low pass filtering output signals of the accelerometers to produce filtered analog signals.

28. The method of claim 27, further comprising the step of converting the filtered analog signals to digital signals.

29. The method of claim 28, further comprising the step of calibrating values of the digital signals representing the output of the accelerometers to adjust for errors caused by temperature and/or misalignment to produce calibrated digital signals.

30. A system for determining rotation rate and/or toolface position information of a rotating downhole drilling tool, comprising:

first, second and third accelerometers mounted to a collar that is controlled to rotate in the downhole drilling tool, each of the first, second and third accelerometers being positioned so that their respective measurement points are centered on an axis of rotation and aligned with respect to a corresponding x, y and z Cartesian coordinate axis of the collar, wherein the x-axis is the axis of rotation of the collar, each of the first, second and third accelerometer generating an output signal;

a fourth accelerometer mounted to said collar and positioned offset from the axis of rotation of the collar by an offset distance and aligned with the second accelerometer, the fourth accelerometer generating a signal representing centripetal acceleration of the collar as a function of the offset distance;

an analog to digital converter coupled to the first, second, third and fourth accelerometers to convert the output signals thereof into digital signals; and a processor device coupled to the analog to digital converter to process the digital signals and generate therefrom one or both of collar rotation rate and toolface position of a bit shaft coupled to the collar through a geostationary offset mandrel.

* * * * *